US005544808A

United States Patent [19]

Aloisi et al.

[11] Patent Number: 5,544,808

[45] Date of Patent: Aug. 13, 1996

[54] PRECONDITIONED PAPERBOARD CONTAINERS

[75] Inventors: Robert J. Aloisi, Neenah, Wis.; Arthur Livingston, Hamilton Township, Pa.; Brian S. Huss, Little Chute, Wis.

[73] Assignee: James River Corporation of Virginia, Richmond, Va.

[21] Appl. No.: 245,544

[22] Filed: May 18, 1994

Related U.S. Application Data

[63] Continuation-in-part of Ser. No. 208,883, Mar. 11, 1994, Pat. No. 5,472,402.

[51] Int. Cl.[6] ..... B65D 3/30

[52] U.S. Cl. ..... 229/400; 220/658; 229/4.5

[58] Field of Search ..... 229/400, 404, 229/4.5; 220/656, 657, 658, 659

[56] References Cited

U.S. PATENT DOCUMENTS

| | | | |
|---|---|---|---|
| 1,751,268 | 3/1930 | Debs | 220/658 |
| 1,814,671 | 7/1931 | DuFour | 229/4.5 |
| 2,993,636 | 7/1961 | Aldington | 229/404 |
| 3,095,132 | 6/1963 | Hawley | 229/404 |
| 3,137,431 | 6/1964 | Crouse et al. | 229/4.5 |
| 3,268,143 | 8/1966 | Bolcato | 229/400 |
| 3,412,654 | 11/1968 | McCandless | 493/158 |
| 4,075,107 | 2/1978 | Smith | 210/493 R |
| 4,471,901 | 9/1984 | Stahlecker | 229/4.5 |
| 4,578,296 | 3/1986 | Miyazaki et al. | 229/400 |
| 4,710,158 | 12/1987 | Knipp et al. | 493/369 |
| 5,472,402 | 12/1995 | Aloisi et al. | 493/159 |

*Primary Examiner*—Gary E. Elkins

*Attorney, Agent, or Firm*—Sixbey, Friedman, Leedom & Ferguson, PC; Donald R. Studebaker

[57] ABSTRACT

Containers and a method for forming such containers having larger brims with reduced brim curl defects is disclosed including providing a plurality of container blanks for forming containers, forming a plurality of container shells from the plurality of blanks, accumulating the plurality of container shells at an accumulation station, subjecting at least an upper periphery of the shells to a humid atmosphere to precondition the shells with the atmosphere preferably including steam, successively removing the shells from the accumulator and subsequently forming a brim curl about an upper periphery of the shell with the shells being subject to the humid atmosphere for a predetermined time period sufficient to form defect-free brim curls by extending the forming strain limits of the paperboard material. This method being carried out by using an accumulator for accumulating the container shells for further processing. Alternatively, the container blanks can be retained in a hopper leaving the portion of the container blank to be formed into the brim of the container exposed.

17 Claims, 11 Drawing Sheets

PRECONDITIONED PAPERBOARD CONTAINERS

This application is a continuation-in-part application of application Ser. No. 208,883, filed Mar. 11, 1994, now U.S. Pat. No. 5,472,402 issued Dec. 5, 1995.

TECHNICAL FIELD

The present invention relates to the formation of paperboard containers and more particularly to a preconditioned paperboard container and method and apparatus for preconditioning the container side wall before brim forming in order to increase forming strain limits and increase the rigidity and acceptability of the resultant container.

BACKGROUND OF THE INVENTION

An ever present concern in the manufacture of paperboard containers is to provide a rigid container which is capable of holding a substantial amount of fluid without collapsing when grasped by the consumer. It is also a major concern that such rigid containers be manufactured in an economical manner to produce a container which will be pleasing to the consumer.

Paper container rigidity is defined by the load which when applied to the side walls of the container deflects the side wall of the container inwardly one quarter of an inch. Further, this test is carried out at a point on the side wall of the container which is two-thirds the height of the overall container. This rigidity test determines the ability of the container to be picked up by the consumer without collapsing inwardly and spilling the contents when the container is grasped by the side wall. The rigidity of a particular container is affected by the tensile and bending stiffness in both the vertical and circumferential directions of the container. One expedient for increasing the rigidity of a paperboard container is to form a brim about the top of the container.

As is disclosed in U.S. Pat. No. 2,473,836 issued to Vixen et al., conventional brim curling mechanism utilizes complimentary curve dies in which the lower die is first moved upwardly around an upper end of the paperboard container to an upper periphery thereof where it firmly holds the cup against the die. The upper die is then moved downwardly to engage the upper periphery of the paperboard container between the dies with both of the dies then moving downwardly together to curl the upper periphery of the container thereby forming a brim. This brim adds significantly to the rigidity of the overall container structure.

Similarly, U.S. Pat. No. 3,065,677 issued to Loeser discloses a brim curling mechanism for paperboard containers. A lower die having a curve forming upper surface is maintained stationary while an upper die having a curve forming lower surface descends downwardly toward the stationary lower die, deflecting the upper edge portion of the cup secured by the lower die and again forming a brim about an upper periphery of the container. This brim as stated previously, adds significantly to the overall rigidity of the container.

As is illustrated in FIG. 1A, each of the above-mentioned containers are formed with the machine direction of the paperboard material aligned in an axial direction of the container and the cross machine direction of the paperboard material aligned in the circumferential direction of the container as shown by the arrows $MD_1$ and $CD_1$, respectively. Paperboard material, when formed using conventional paper manufacturing processes, has what is known in the art as a "machine direction and a cross machine direction." The machine direction of the paper is generally that axis of the paper along which the paper is moved as it was being formed. The cross machine direction is perpendicular to the machine direction of the paper and has approximately twice the maximum stretch as that of the machine direction, while the tensile and bending stiffness of the board in the machine direction is greater than that in the cross machine direction. Therefore, in order to easily form brims about the upper periphery of the container, the paperboard blank used in forming the cup is generally positioned as illustrated in FIG. 1A.

In an effort to increase the overall rigidity of the paperboard container and to increase the paperboard container's acceptance by the consumer by eliminating cracks in the brim curl, U.S. Pat. No. 5,029,749 issued to Aloisi and assigned to the assignee of the subject invention proposes reorienting the paperboard material when forming the blanks in accordance with conventional practices. That is, the machine direction of the paperboard material is oriented so as to extend in the circumferential direction of the paperboard container with the cross machine direction of the paperboard container being aligned with the axial direction of the container as illustrated in FIG. 1B. While this orientation of the paperboard material does in fact result in an increased rigidity of the container, the size of the brim curl formed about an upper periphery of the container is limited by the orientation and properties of the paperboard materials. That is, because board stretch in the machine direction is less than that in the cross machine direction the size of brim curls about the upper periphery of the container will be smaller than brim curl of the container illustrated in FIG. 1A.

The use of moisture in aiding in the formation of brim curls has been known as illustrated in European Patent Application No. 0,129,064 wherein a brim forming press for forming brim curls includes a spray and nozzle for producing an annular spray pattern of atomized water and directing such spray on the inside top margin of the annular wall of the cup during engagement of the deflector with an upper periphery of the cup. However, the atomized water is used to lubricate the top margin of the annular cup when forming the brim curls in a convention manner. In doing so, the frictional engagement between the cup and the forming press is lessened.

Similarly, U.S. Pat. No. 2,541,905 issued to Amberg discloses the moistening of the upper portion of a cup in order to form satisfactory brims on the cup. Again, the moistening of the upper portion of the cup is done so as to aid in the formation of a brim curl about the upper periphery of the cup in a conventional manner. This being done at the brim curling station.

In addition to the foregoing, U.S. Pat. No. 1,743,215 issued to Hill discloses a process for the production of paper containers and particularly cup-shaped paperboard containers having rolled rims where the edge rolling step of the process can be executed more advantageously if the edge to be rolled is moistened before being subjected to a rolling process. Herein, as with the above-noted references, the formation of brim curls about an upper periphery of a paperboard container utilizing conventional forming devices can be aided with the use of moisture. Particularly, in U.S. Pat. No. 1,743,215, a stack of disks to be formed into paper cups is formed with the edges of the disks being moistened for edge forming purposes while maintaining the central portion of the disk dry. These disks are then subsequently formed into paper cups using conventional forming devices. That is, the disclosure of Hill has recognized that by subjecting the blanks to moisture, brim curls of a conventional size and shape can be more readily carried out. However, the use of moisture in the Hill disclosure does not increase the overall rigidity of the resultant container.

Clearly, there is a need for a container and more specifically a paperboard container which exhibits an increased degree of rigidity than that previously achieved by producing a paperboard container having an enlarged brim curl about an upper periphery thereof adds to the rigidity of the paperboard container and provides a paperboard container which is more acceptable to the consumer without increasing the basis weight of the paperboard material.

SUMMARY OF THE INVENTION

It is a primary object of the present invention to overcome the shortcomings associated with previously-known paperboard containers.

Yet another object of the present invention is to increase the forming strain limits in order to improve rigidity of the resultant container by allowing larger brims than previously-known to be formed about an upper periphery of the container.

Another object of the present invention is to provide a device for systematically subjecting a brim portion of a container blank or shell to a humid atmosphere in order to extend the forming strain limits encountered during formation of brim curls about an upper periphery of the container.

A further object of the present invention is to insure proper exposure of the upper periphery of the paperboard blank or shell to the humid atmosphere in order to significantly reduce and eliminate defects in the brim curl of the resultant container.

A further object of the present invention is to provide a process for extending the forming strain limits encountered when forming paperboard containers from paperboard blanks having the machine direction of the paperboard material extending in a circumferential direction of the resultant container in order to permit larger brim curls to be formed about an upper periphery of the container.

A further object of the present invention is to provide a method and apparatus for increasing the paperboard moisture content in order to readily form brim curls about an upper periphery of a container formed from such paperboard material without brim-cracking defects.

These as well as additional objects of the present invention are achieved by providing a plurality of container blanks for forming containers, forming a plurality of container shells from the plurality of blanks, accumulating the plurality of container shells at an accumulation station, subjecting at least an upper periphery of the shells to a humid atmosphere to precondition the shells with the atmosphere preferably including steam, successively removing the shells from the accumulator and subsequently forming a brim curl about an upper periphery of the shell with the shells being subject to the humid atmosphere for a predetermined time period sufficient to form defect-free brim curls by extending the forming strain limits of the paperboard material. This method being carried out by using an accumulator for accumulating the container shells for further processing with the accumulator including an elongated housing for accommodating the plurality of shells, a mechanism for retaining the shells in the housing and at least one elongated injection manifold extending along a length of the housing and having a plurality of injection orifices for directing steam into contact with the shells. Alternatively, the container blanks can be retained in a hopper leaving the portion of the container blank to be formed into the brim of the container exposed with the retaining device including a positioning frame for positioning the plurality of blanks and maintaining the blanks in a substantially upright position, a restraining mechanism for restraining the plurality of blanks in the retaining device and permitting the blanks to be sequentially removed from the positioning frame and an injection manifold extending parallel to the blanks for directing steam toward an upper portion of the blank. Again, the blanks are subjected to a humid atmosphere for a time sufficient to form substantially defect-free brim curls by extending the forming strain limits of the paperboard material. Additionally, depending upon the type of container being formed, it may only be necessary to subject segments of the portion of the blank which is to be formed into the brim to the humid atmosphere. Accordingly, the injection manifold is to be positioned in such a manner to only effect those segments resulting in the economical use of the steam while limiting blank warp. This being particularly useful when forming square or rectangular containers having rounded corners.

These as well as additional objects of the present invention will become apparent from the following detailed description of the invention when read in light of the several figures.

DETAILED DESCRIPTION OF THE PRESENT INVENTION

As discussed hereinabove, paperboard containers having brim curls formed about an upper periphery thereof may be formed having the machine direction of the paperboard material extending in either the axial direction of the container or the circumferential direction of the container. That is, as can be seen from FIG. 1A, paperboard containers 2 are manufactured with the machine direction of the paperboard blank being aligned in the vertical or axial direction of the container as designated by arrow $MD_1$ and the cross machine direction of the paperboard material is aligned in the circumferential direction of the container as illustrated by arrow $CD_1$. Because the cross machine direction of the paperboard material exhibits a maximum stretch of approximately twice that of the machine direction, a brim curl 4 can be readily formed about an upper periphery of the cup 2 while avoiding the formation of vertical cracks about the brim. It should be noted, however, that even with the machine direction of the paperboard material extending in the axial direction of the cup, the size of the brim curl 4 formed about an upper periphery of the container is subject to forming strain limits which dictate the formation of the brim curl. As discussed hereinabove, it is an object of the present invention to provide a method and apparatus for forming larger brim curls than those previously achieved on paperboard containers having the machine direction of the paperboard material extending in an axial direction of the container.

Further, as discussed hereinabove and with reference to FIG. 1B, it has been found that in order to enhance the overall rigidity of the paperboard container, the paperboard material is reoriented in a manner such that the machine direction of the paperboard material is aligned in the circumferential direction of the cup 2' as illustrated by arrow $MD_2$ and the cross machine direction of the paperboard material is aligned in the vertical or axial direction of the container 2' as illustrated by arrow $CD_2$. By reorienting the paperboard material in the manner illustrated in FIG. 1B, a greater rigidity against deformation of the container when grasped by the consumer as compared to previously-known paperboard containers is achieved in that as discussed in U.S. Pat. No. 5,029,749 it has been determined that the container rigidity is strongly dependent on the stiffness of the side wall about its circumference.

Figure 1B:
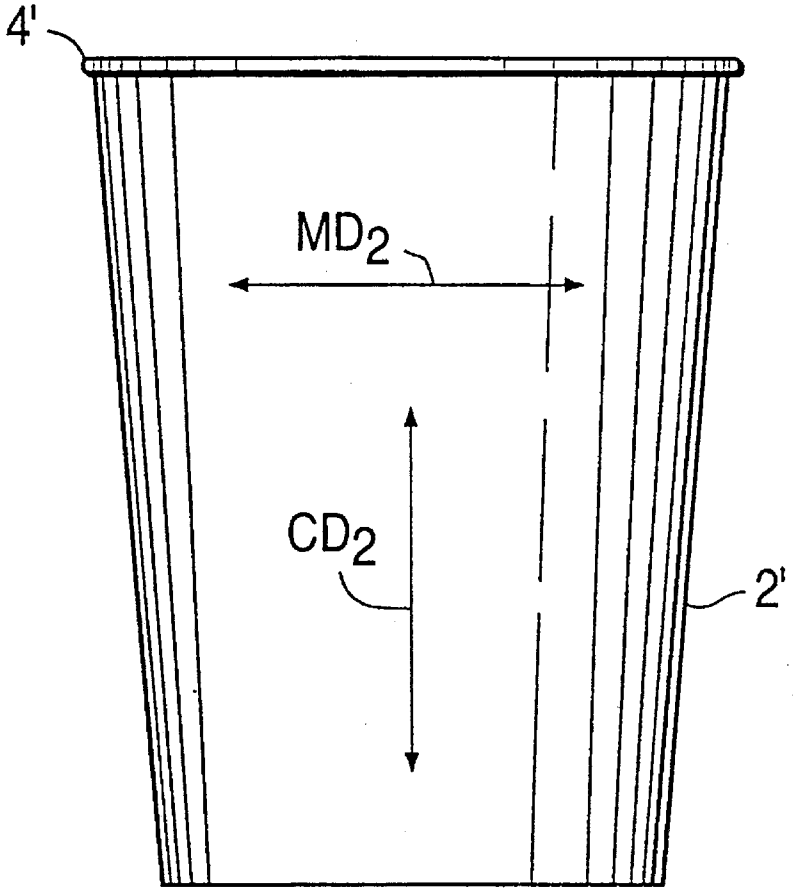
FIGS. 1A and 1B are elevational views of a container illustrating the paperboard orientation of containers formed in accordance with the present invention.
Figure 1A:
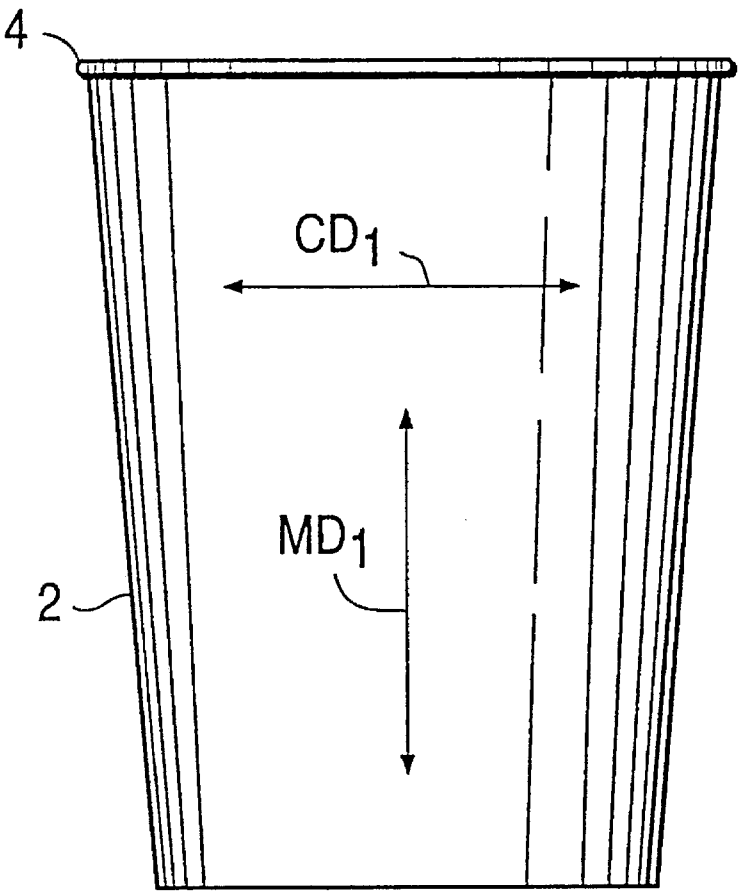
Figure 2A:
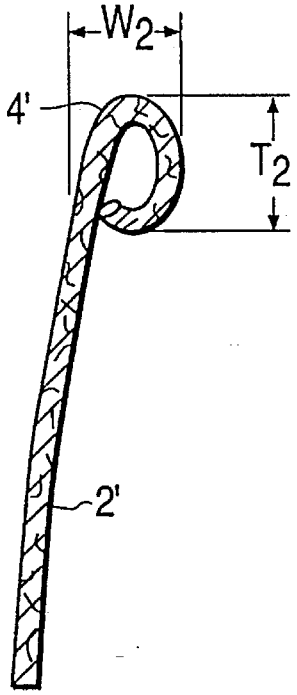
FIG. 2A is a cross-sectional view of a brim curl formed about an upper periphery of the container illustrated in FIG. 1B when using conventional forming methods.
Figure 2B:
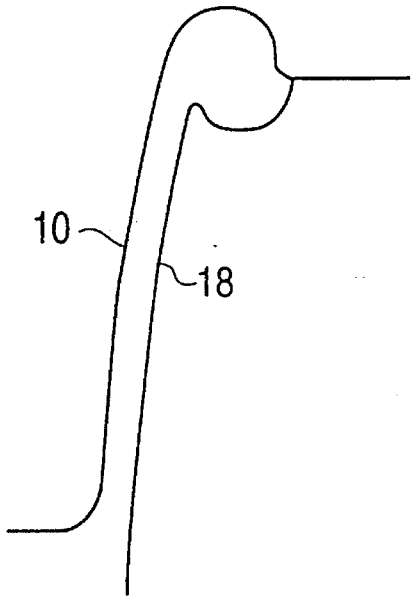
FIG. 2B is a schematic representation of the cooperating tool dies for forming the brim curl of FIG. 2A.
Figure 3A:
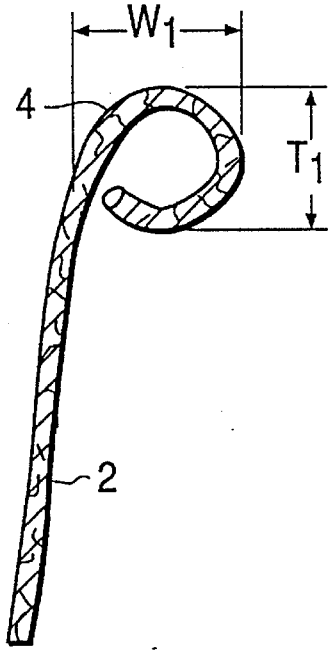
FIG. 3A is a cross-sectional view of a brim curl formed about an upper periphery of the container illustrated in each of FIGS. 1A and 1B when formed in accordance with the present invention.
Figure 3B:
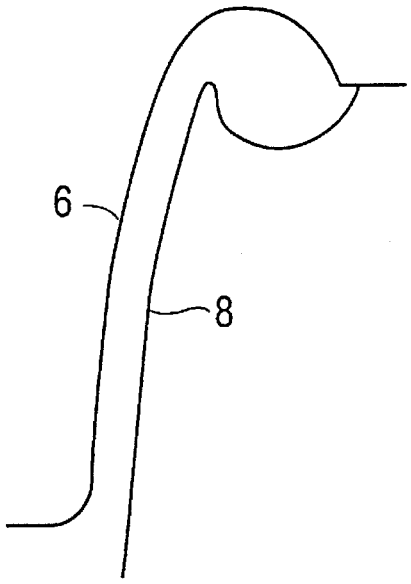
FIG. 3B is a schematic representation of the cooperating tool dies for forming the brim curl of FIG. 3A.

Referring now to FIGS. 2A and 2B, when reorienting the paperboard material in the manner illustrated in FIG. 1B, brim curls formed in accordance with conventional methods exhibit a width W2 and a thickness T2 and are formed by the cooperating dies illustrated in FIG. 2B. Because the paperboard material is reoriented in a manner such that the machine direction of the paperboard material is aligned in the circumferential direction of the container, heretofore, only brim curls of a smaller size due to the lower stretch in the machine direction were permitted in order to minimize brim curl defects of the resultant containers. In accordance with the present invention, brim curls having a wider dimension W1, as illustrated in FIG. 3A, can be provided when a paperboard container is manufactured having the paperboard material oriented in the manner illustrated in either FIG. 1A or FIG. 1B. Similarly, forming dies 6 and 8 illustrated in FIG. 3B having a wider dimension may be used in forming brim curls in accordance with the present invention. It should be noted that while larger brim curls are achieved using both paperboard orientations when compared to conventional brim curls the brim curls achieved for the container having the paperboard oriented as illustrated in FIG. 1A will be larger than those of the container illustrated in FIG. 1B.

Figure 4:
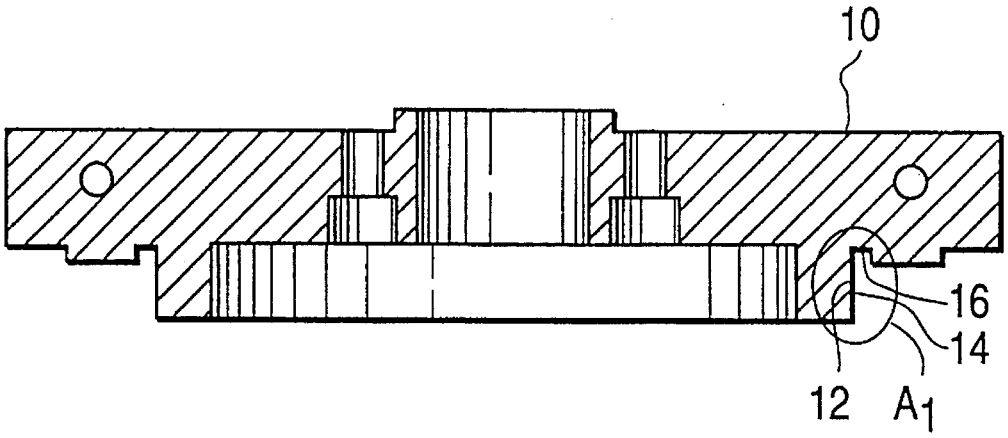
FIG. 4 is a cross-sectional view of an upper tool die for forming brim curls in accordance with the present invention.
Figure 5:
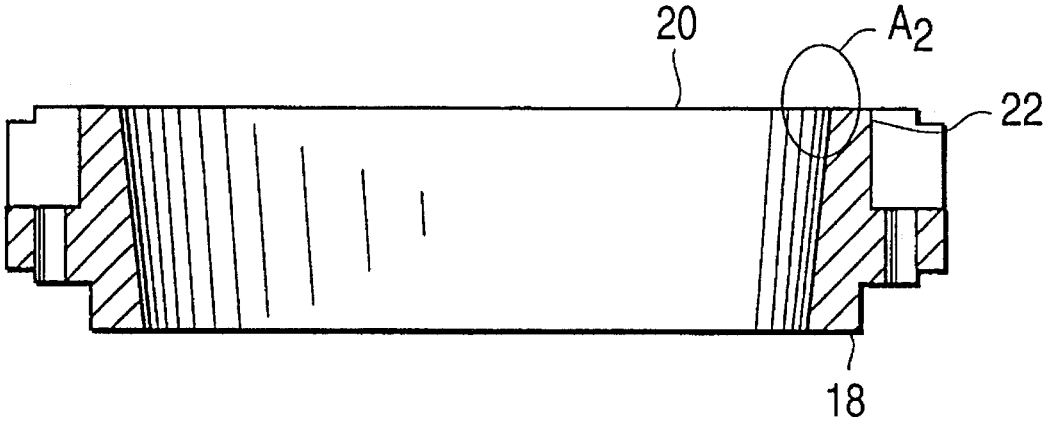
FIG. 5 is a cross-sectional view of a lower tool die for forming the brim curl in accordance with the present invention.

Turning now to FIGS. 4 and 5, the particular die arrangement for forming the brim curls about an upper periphery of the paperboard containers are formed in a conventional manner using the male and female die arrangement illustrated. Specifically, FIG. 4 illustrates an upper or male die 10 which may be manipulated by conventional brim-forming devices such as those illustrated in U.S. Pat. Nos. 2,473,836 and 3,065,677 discussed hereinabove. The upper die 10 includes a lower surface having a flange 12 extending axially therefrom thereby providing a slanted outer surface 14 and an under cut 16, the significance of which will be described in greater detail hereinbelow. The lower or female die 18 illustrated in FIG. 5 includes an axial bore 20 for receiving a container shell formed from paperboard material which may have the machine direction oriented in either the axially direction of the container or the circumferential direction of the container with the bore 20 having an upper diameter corresponding to the diameter of the container shell at the point where the brim is to be formed, and a lower diameter which corresponds to an adjacent portion of the container shell in order to secure the shell in position during formation of the brim curl. As illustrated in FIG. 5, the lower diameter is less than the upper diameter in that containers having a tapered side wall as illustrated in FIGS. 1A and 1B are being formed. However, containers having vertically extending side walls may also be readily formed in accordance with the present invention. Further, as with conventional forming dies, the upper periphery of the bore 20 includes a channel 22 which receives the paperboard material during formation of the brim curl. Again, while the overall construction of the die arrangement is essentially as conventionally known, the size of the undercut 16 and channel 22 are larger than those used previously for forming containers of the same size and paperboard properties.

Figure 6A:
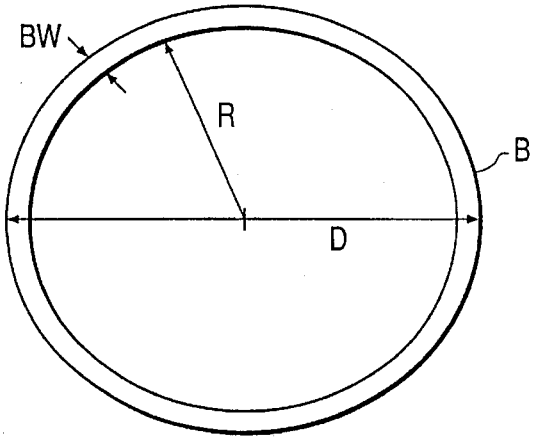
FIGS. 6A, 6B and 6C are top views of containers formed in accordance with the present invention.
Figure 6B:
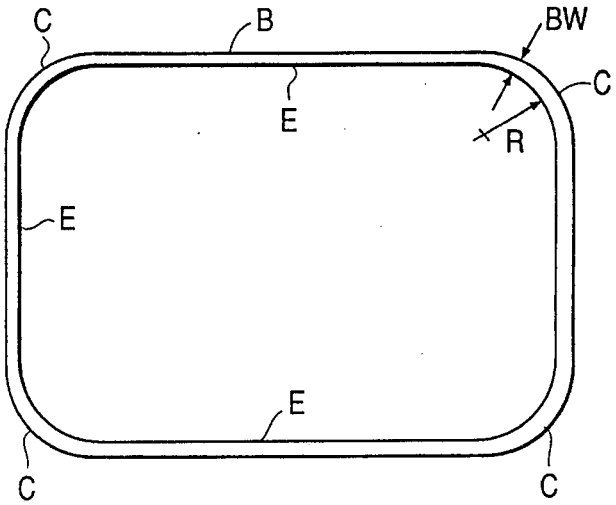
Figure 6C:
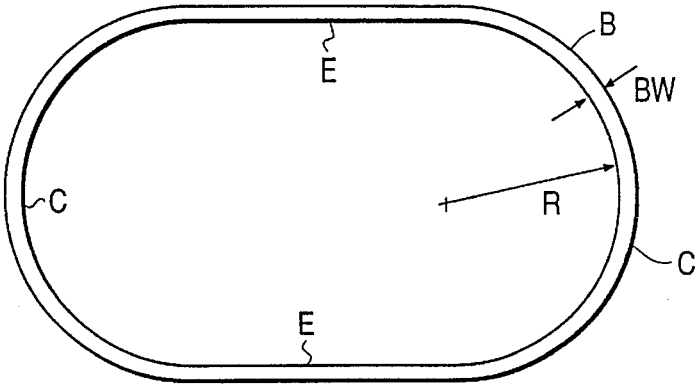

Paperboard containers may be formed in a variety of configurations in accordance with the present invention. As can be seen from FIGS. 6A, 6B and 6C, the paperboard container may be either circular as illustrated in FIG. 6A, rectangular or square as illustrated in FIG. 6B, or oblong as illustrated in FIG. 6C. Each of these containers benefit from forming the brim curls B in a manner consistent with the present invention.

In some instances, and particularly when forming containers in the configuration illustrated in FIGS. 6B and 6C, the upper periphery of the container blank need only be moistened about a portion of the upper periphery. That is, when forming the container illustrated, in FIG. 6B, only the portions of the upper periphery of the blank which form the rounded corners C need be moistened in that the brims of the elongated sides E of the container are not subjected to the degree of strain during formation that the rounded corners C are.

As discussed previously, by forming containers in accordance with the present invention, the forming strain limits may be extended to permit larger brim curls to be formed than with conventional methods. The maximum forming strain is a function of the basis weight of the paperboard material, moisture content and stretch of the paperboard material with the forming strain limiting the size of the brim curl which may be formed without defects.

In accordance with the present invention, a paperboard container formed from a paperboard material having a basis weight in the range of 60 to 300 pounds per 3,000 square feet (60 to 300 lbs/RM) and preferably 120 to 220 lbs/RM is formed having a brim curl formed about an upper periphery of the container with the forming strain of the container satisfying the formula:

$$FS=\left(\frac{BWC_f}{R+BW(1-C_f)}\right)100=\left(\frac{2BWC_f}{D-2BWC_f}\right)100$$

where BW is a brim width of the container, D is a diameter of the container at an outer periphery of the brim, R is an inner radius of the curvature of the container at the brim and $C_f$ is a correction factor to account for the tapered side wall of the container. These dimensions being illustrated in each of FIGS. 6A, 6B and 6C. The correction factor $C_f$ for a tapered container satisfies the formula:

$$C_f=1-\frac{\pi\cdot\sin\theta}{2}$$

where θ is the side wall taper in degrees.

With respect to the container configurations illustrated in FIGS. 6B and 6C, the greatest point of strain on the paperboard material is at the region where the brim curl is curved. Accordingly, the forming strain is thus determined in this region. A container formed in accordance with the present invention being void of brim curl defects in the curved region will be void of brim curl defects along the elongated portions of the brim curl B as well.

Figure 7:
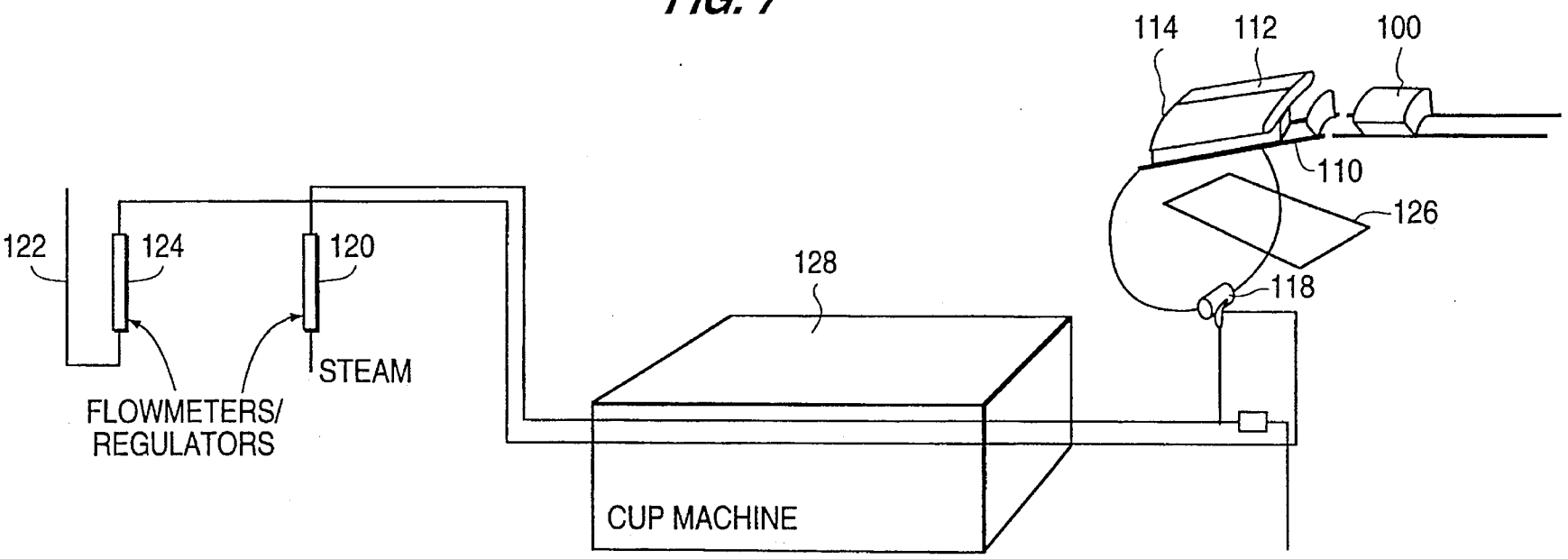
FIG. 7 is a schematic illustration of a brim conditioning system in accordance with the present invention.

Referring now to FIG. 7, a first embodiment of forming containers in accordance with the present invention will be discussed in detail. In this embodiment, container blanks 100 are formed from a known stamping process and positioned within a hopper 110 in a conventional manner for subsequent removal and manipulation into the resultant container. In accordance with the present invention, the hopper 110 includes a hood 112 which will be discussed in greater detail hereinbelow. Provided in the hood 112 at an outlet end 114 thereof, is an injection manifold for generating a humid atmosphere within the hood 112 of the hopper 110. Steam is provided and directed to an air steam mixing manifold 118. The steam passes through a regulator 120 in order to regulate the amount of steam being supplied to the air/steam mixing manifold. Similarly, low pressure air is provided through the passage 122 and regulated by regulator 124 before being passed to the air/steam mixing manifold 118 where a predetermined air/steam mixture is formed and passed to the hood 112. While the surface of the hood 112 is heated using strip heaters to minimize condensation, the hopper 110 includes a drip pan 126 for draining any condensation which may be created from the hopper 110.

The container blanks 100 are retained within the hood 112 of the hopper 110 for a time period sufficient to moisten the portion of the blank 100 which is to form the brim curl of a resultant container. This time period being in the range of 80 to 150 seconds and preferably 100 to 120 seconds. The hood 112 would thus be dimensioned so as to retain the container blanks within the hood for a predetermined time period dependent upon the number of containers per minute being manufactured by the container manufacturing device 128. As with conventional container manufacturing devices, the container blanks are sequentially removed from the hopper and formed in a continuous manner.

Figure 8:
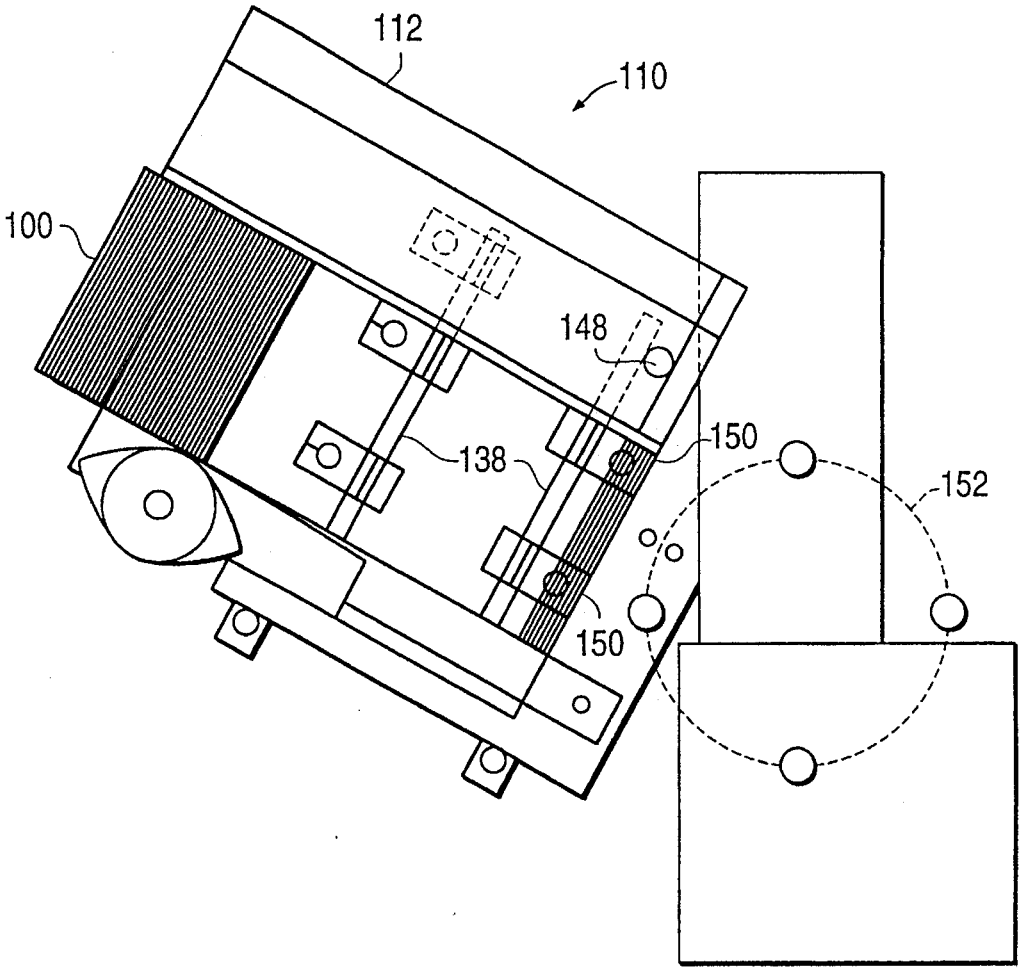
FIG. 8 is a schematic illustration of a container blank hopper incorporating the brim conditioning system in accordance with the present invention.
Figure 9:
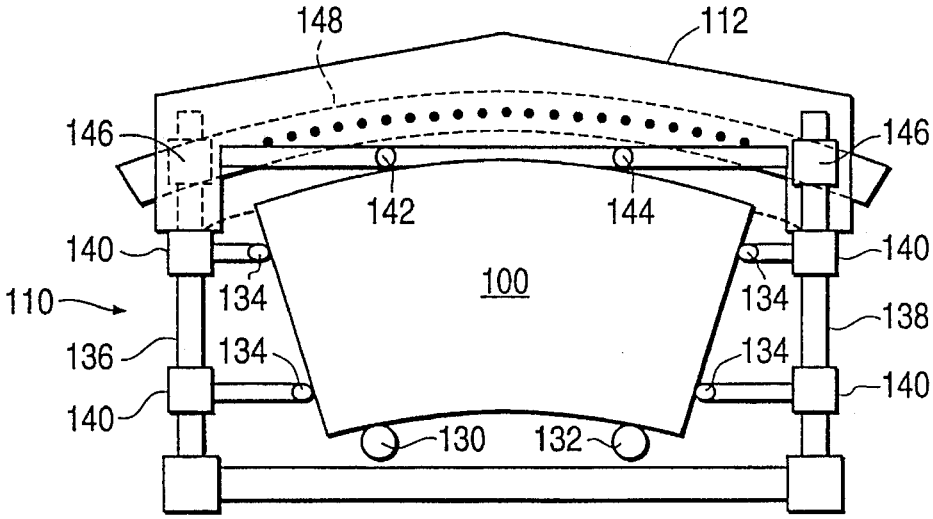
FIG. 9 is an end view of the container blank hopper illustrated in FIG. 8.
Figure 11:
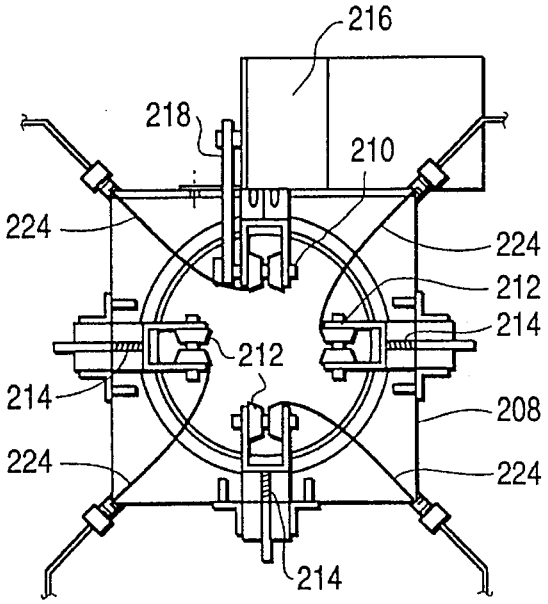
FIG. 11 is a bottom view of the accumulator of FIG. 10 illustrating the retaining mechanism for permitting sequential removal of containers from the accumulator.

Referring now to FIGS. 8 and 9, the construction of the hopper 110 will be explained in detail. As discussed previously, the container blanks 100 are positioned within the hopper 110 and are supported on support rails 130 and 132. Lateral support rails 134 are also provided in order to maintain the paperboard blanks in a substantially upright position. It should be noted that the position of the support rails 134 are variable by adjusting the vertical position along columns 136 and 138 such that the hopper 110 can accommodate a variety of container blank configurations. The rails 134 being adjusted in a conventional manner through the adjustment means 140. Similarly, upper support rails 142 and 144 are provided and readily adjustable by adjustment means 146 along columns 136 and 138, respectively. The rails 142 and 144 again may be adjusted in order to accommodate a variety of container blank configurations. While the blanks are illustrated as being substantially upright, it may in some instances be advantageous to permit the blanks lean either forward or backward in order to expose a greater portion of the brim region of the blank to the humid atmosphere.

The hopper 110 also includes the hood 112 which extends along a substantial length of the carton blank stack. Also positioned above the carton blank stack is an injection manifold 148 which is positioned at an outlet end of the hopper 110 for forming a humid atmosphere within the hood 112. As discussed hereinabove, the injection manifold is connected to the air/steam mixing manifold for injecting a predetermined amount of steam into the hood 112 of the hopper 110. Steam is mixed with air at a ratio in the range of 0.1 CFM (cubic feet per minute) steam per 1.0 CFM air to 1.0 CFM steam per 1.0 CFM air. The requisite ratio is dependent upon a number of variables including the initial moisture content of the paperboard material, the paperboard characteristics and thickness as well as the relative humidity of the surrounding environment. Also positioned at a forward end of the hopper 110 are restraining mechanisms 150 which restrain the container blanks 100 within the hopper in a manner such that a removal turret, illustrated schematically as turret 152, can sequentially remove the furthestmost blank from the hopper 110 for further processing.

Figure 10:
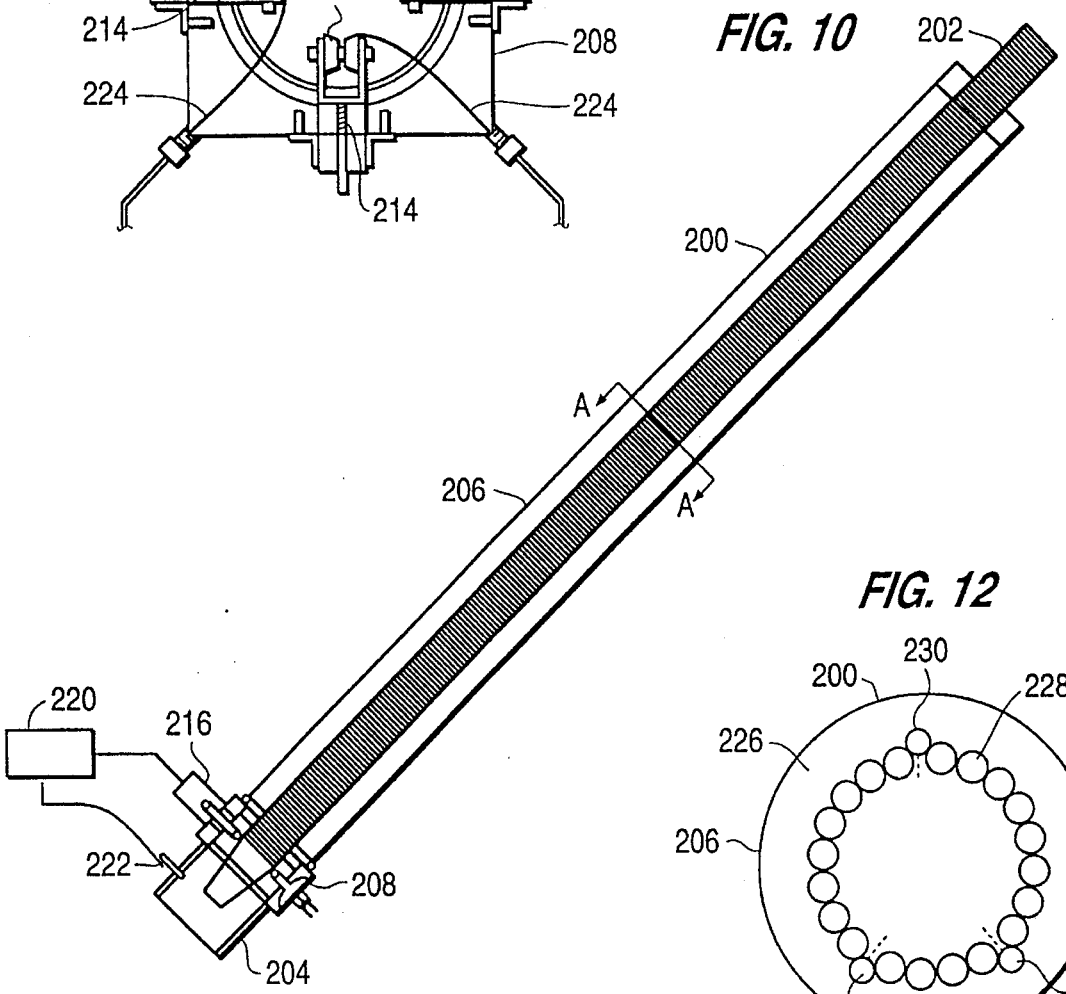
FIG. 10 is an elevational view of an accumulator for accumulating paperboard container shells for further processing in accordance with the present invention.

Referring now to FIGS. 10 through 15 and in particular, FIG. 10, a preferred embodiment of the present invention will be discussed in greater detail. FIG. 10 illustrates an accumulator 200 for accumulating container shells 202 which have been previously formed in accordance with conventional container manufacturing processes. The shells 202 are retained within the accumulator 200 and sequentially removed from a lowermost end 204 of the accumulator 200 and dispensed into a receiving pocket at a conventional forming station for forming brim curls about an upper periphery of the container shell 202. The accumulator 200 includes a housing 206 having an inlet and outlet for receiving and dispensing container shells 202, respectively. The output end of the accumulator 200 includes a retaining and dispensing mechanism 208 which is illustrated in detail in FIG. 11. As illustrated therein, the retaining device 208 includes a drive wheel 210 for intermittently dispensing a container shell 202 from the accumulator 200. The retaining device 208 also includes a plurality of biased support wheels 212 which are urged against the container shells by springs 214 in order to aid in the proper alignment and dispensing of the container shell. The drive wheel 210 is intermittently driven by motor 216 by way of belt 218 with the motor being controlled by control unit 220 which senses the position of the lowermost container shell by way of sensor 222. While only one of the wheels is illustrated as being a drive wheel, more than one and possibly all four of the wheels may be driven by motor 216 or similar drive mechanism. The wheels 210 and 212 position the lowermost shell 202 in a manner such that air jets 224 can sequentially remove one shell at a time while the subsequent shells are restrained by the wheels. The air jets are operated in timed sequence with the cup forming machine so that the shell is properly dispensed into the bore in die 18 when the die is positioned below the dispensing mechanism 208.

Figure 12:
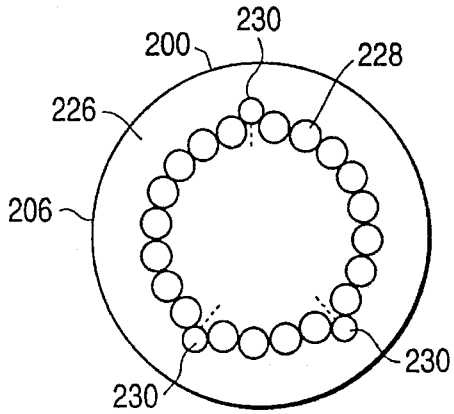
FIG. 12 is a cross-sectional view taken along line A—A of FIG. 10.

Provided within the housing 206 of the accumulator 200 and in surrounding relationship about the container shells 202 is the system for creating a humid atmosphere within the accumulator 200. As is illustrated in FIG. 12, a low pressure air passage 226 is provided about an interior of the housing 206 and surrounds a plurality of steam passages 228 which extend along a length of the housing 200. Also provided within the housing 206 are injection manifolds 230 for injecting the humid atmosphere into contact with the container shells 202. While FIG. 12 illustrates three injection manifolds, any number of injection manifolds may be utilized so long as an appropriate atmosphere is provided about the container shells 202.

Figure 13:
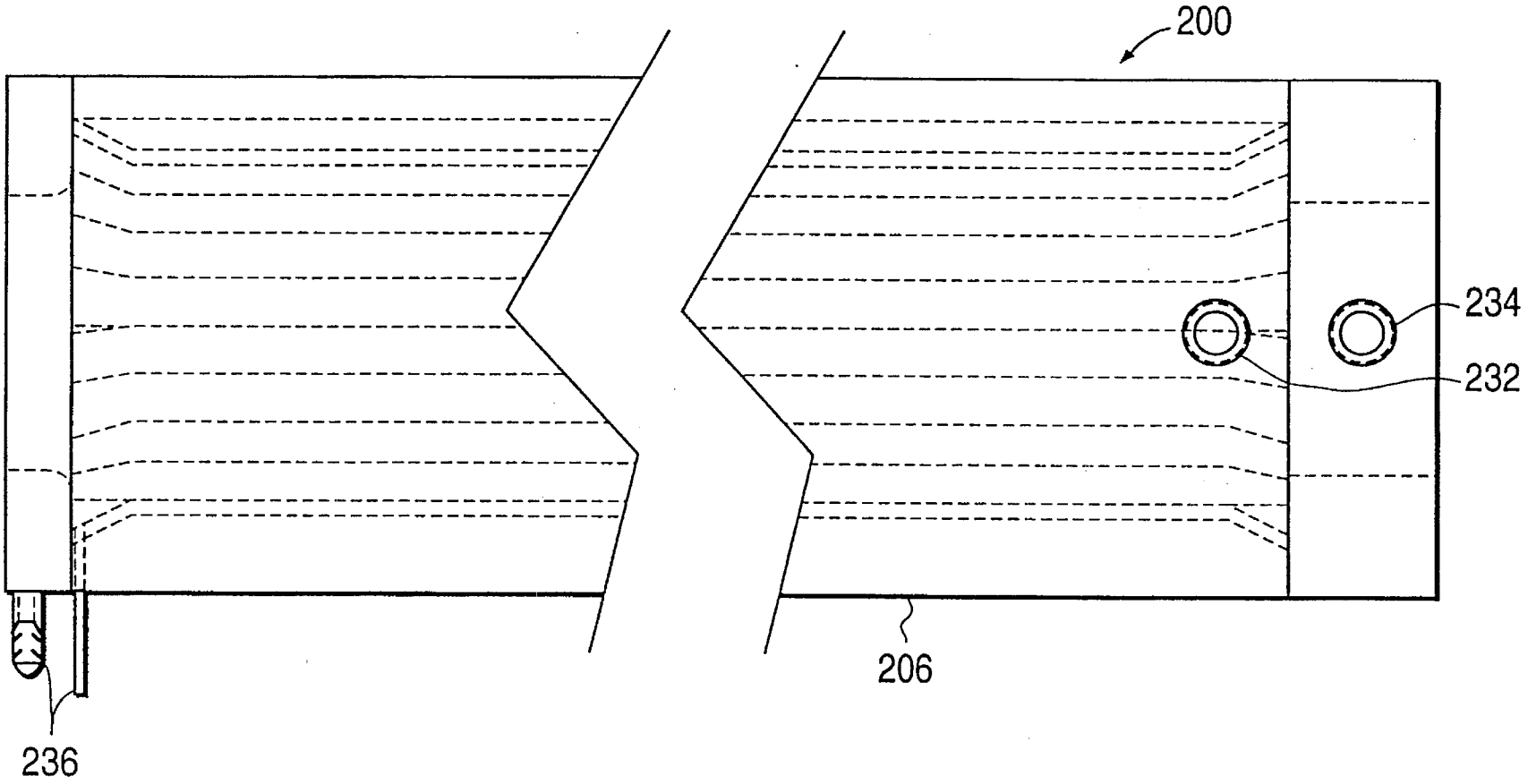
FIG. 13 is a schematic illustration of the brim conditioner provided in the accumulator in accordance with the present invention.

Referring to FIG. 13, a lower pressure air inlet 232 is provided for introducing the low pressure air into the low pressure air passage 226 and a steam inlet 234 is provided for allowing steam to pass into the steam passages 228. Condensation drain passages 236 are provided at a lowermost end of the housing 200 in order to permit any condensation to be drained from the housing. Steam is mixed with air at a ratio in the range of 0.1 CFM (cubic feet per minute) steam per 1.0 CFM air to 1.0 CFM steam per 1.0 CFM air. As discussed previously, the requisite ratio is dependent upon a number of variables including the initial moisture content of the paperboard material, the paperboard characteristics and thickness as well as the relative humidity of the surrounding environment.

Figure 14:
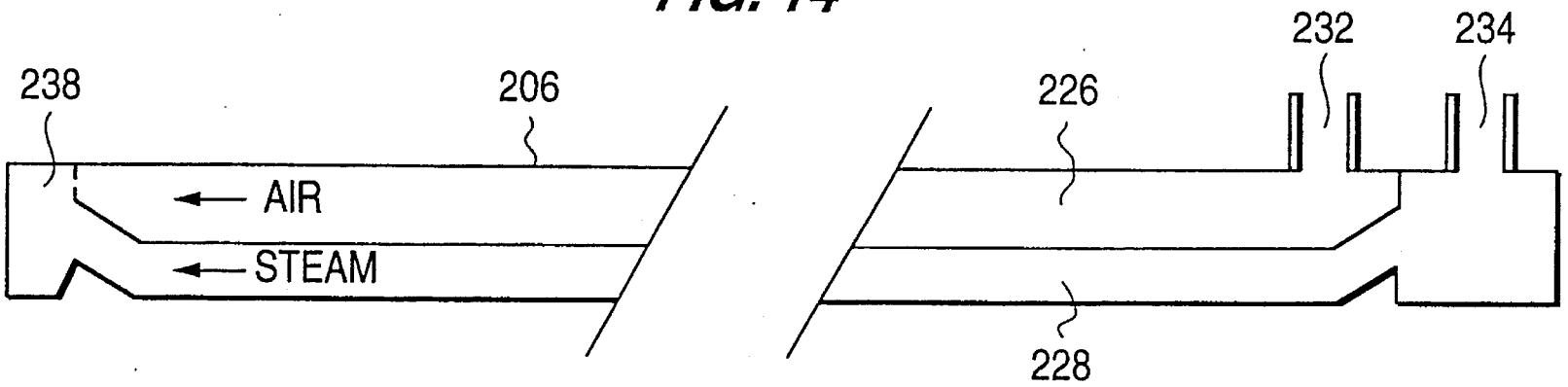
FIG. 14 is a schematic illustration of a portion of the brim conditioner illustrated in FIG. 13.
Figure 15:
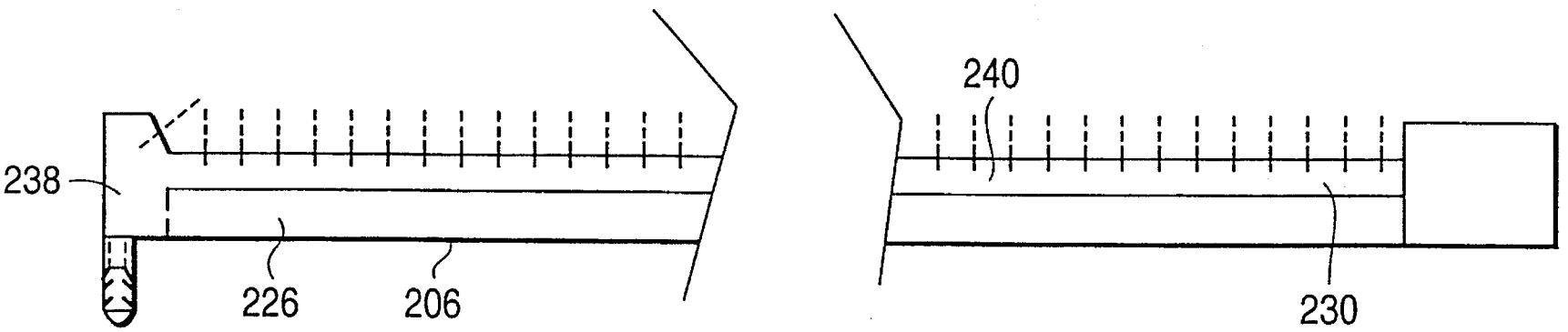
FIG. 15 is a schematic illustration of an injection manifold provided in the brim conditioner illustrated in FIG. 13.

With reference now being made to FIG. 14, air and steam are provided to their respective inlets in a manner similar to that illustrated in FIG. 7, and discussed hereinabove. The flow of both the air and steam being regulated by regulators such that a proper air/steam mixture can be formed in the mixing manifold 238. Once the proper air/steam mixture is formed within the mixing manifold 238, the mixture is forced under lower pressure into the injection manifold 230 and through the plurality of injection orifices 240 provided in the injection manifold 230. Again, the number of injection manifolds and injection orifices is dependent upon the amount of steam desired on the shells 202. It should be noted that the humid atmosphere in both the hopper and accumulator discussed hereinabove is achieved by the use of steam. While steam has been determined to provide superior results, moisture in the form of atomized water may also effectively be used in each of the above-noted devices.

As with the previous embodiment, it is desired that the container shells be maintained in the humid atmosphere for a time period in the range of 80 to 150 seconds and preferably 100 to 120 seconds. In doing so, an example of the dimensions of an accumulator for forming sixteen ounce cups at 153 cups per minute would be approximately 75 inches long in order to provide sufficient conditioning time. Further, the accumulator and its selective components are preferably formed of stainless steel.

The particular board properties of the paperboard material from which either the container blanks or container shells are formed has an impact on brim curl defects as is illustrated in Table I.

TABLE I

Accumulator Steam Trial

| | Large Brim Cups Strain > 4.41 + 0.0156 × B | | | |
|---|---|---|---|---|
| | BASIS | CD | DEFECTS | |
| TRIAL | WT | STRETCH | CONTROL | STEAM |
| I | 120 | 5.0 | 2.8 | 0.2 |
| | 130 | 5.2 | 2.4 | 0.0 |
| | 140 | 5.3 | 1.5 | 0.0 |
| II | 120 | 5.5 | 2.9 | 0.0 |
| | 130 | 5.7 | 2.1 | 0.0 |
| III | 220 | 5.4 | 3.0 | 0.0 |

| | Reoriented Blank Cups Strain > 4.0% | | | |
|---|---|---|---|---|
| | BASIS | CD | DEFECTS | |
| TRIAL | WT | STRETCH | CONTROL | STEAM |
| I | 120 | 2.9 | 2.8 | 0.2 |
| | 130 | 2.7 | 2.5 | 0.0 |
| | 140 | 2.5 | 2.3 | 0.0 |
| II | 120 | 2.4 | 3.0 | 1.8 |
| | 130 | 3.6 | 2.8 | 0.0 |
| III | 220 | 2.8 | NO DATA | 0.0 |

Defect Key:
0 = None
1 = Slight - dimples, no visible cracks
2 = Moderate - visible cracks on outside of brim
3 = Severe - large cracks which propagate to inside of cup Cup shells were made from paperboard material having three various basis weights of approximately 120 pounds per ream, 130 pounds per ream and 140 pounds per ream. As can be seen from Table I, the severity of the defects decreases as board stretch increases and board basis weight increases. Less severe defects occur with large brim cups formed using 140 pounds per ream board which has a 5.3% stretch than with the 120 pounds per ream board having a 5.0% stretch. Further, cups formed from paperboard material having a basis weight of 220 pounds per ream exhibit a reduction in brim defects when preconditioned with steam. Accordingly, as can be seen from Table I, preconditioning the blanks and shells with steam prior to formation of the brim curls significantly reduces and often eliminates undesirable brim curl defects.

In addition to the basis weight of the paperboard material used in forming the paperboard containers, the conditioning settings, that is the time, temperature and amount of moisture, also affect the formation of brim curls about an upper periphery of the container. Table II illustrates results of trials conducted using various conditioning settings in the accumulator embodiment of the present invention for forming large brim cups.

TABLE II

| Accumulator Steam Trial Large Brim Cups Strain > 4.41 + 0.0156 × B | | | |
|---|---|---|---|
| CONDITIONING SETUP | TIME (sec.) | 120 Lbs/RM | 130 Lbs/RM |
| C1. Control - Dry Board | — | 3.0 | 2.8 |
| C2. Hot Air (200 F.) | 100 | 3.0 | 2.4 |
| C3. Steam - Low Flow Rate | 100 | 1.6 | 1.8 |
| C4. Steam - High Flow Rate | 30 | 1.4 | 1.0 |
| C5. Steam - High Flow Rate | 60 | 1.4 | 0.2 |
| C6. Steam - High Flow Rate | 100 | 0.6 | 0.0 |
| C7. Steam - High Flow Rate | 120 | 0.0 | 0.0 |

Defect Key:
0 = None
1 = Slight - dimples, no visible cracks
2 = Moderate - visible cracks on outside of brim
3 = Severe - large cracks which propagate to inside of cup Accordingly, by subjecting the container shells to a humid atmosphere as discussed hereinabove results in the formation of paperboard containers exhibiting no visible defects which results in a container having an increased rigidity and which is pleasing to the consumer.

Further tests were conducted in order to compare the brim forming characteristics achieved in accordance with both the preferred embodiment and alternative embodiment set forth hereinabove. As can be seen from Table III hereinbelow, trials were conducted for both large brim cups and reoriented blank cups using both the hopper and accumulator embodiments.

TABLE III

| Comparison of Conditioning Methods | | | |
|---|---|---|---|
| Large Brim Cups Strain > 4.41 + 0.0156 × B | | | |
| LOCATION | METHOD | 120 LBS/RM | 130 LBS/RM |
| HOPPER | CONTROL | 2.8 | 0.8 |
| 100 seconds of | SPRAY | 2.4 | 0.0 |
| conditioning | STEAM | 1.5 | 0.0 |
| ACCUMULATOR | CONTROL | 2.9 | 2.1 |
| 100 seconds of | SPRAY | 2.7 | 2.1 |
| conditioning | STEAM | 0.0 | 0.0 |
| Reoriented Blank Cups Strain > 4.0% | | | |
| LOCATION | METHOD | 120 LBS/RM | 130 LBS/RM |
| HOPPER | CONTROL | 3.0 | 2.4 |
| 100 seconds of | SPRAY | 2.9 | 2.0 |
| conditioning | STEAM | 2.8 | 0.5 |
| ACCUMULATOR | CONTROL | 3.0 | 2.8 |
| 100 seconds of | SPRAY | 3.0 | 2.5 |
| conditioning | STEAM | 1.8 | 0.0 |

Defect Key:
0 = None
1 = Slight - dimples, no visible cracks
2 = Moderate - visible cracks on outside of brim
3 = Severe - large cracks which propagate to inside of cup Each was subjected to brim conditioning for 100 seconds using both moisture spray and steam. Therein, when forming large brim cups using the accumulator set forth hereinabove, and subjecting the paperboard shells to a humid atmosphere including steam, no brim defects were detected. Again, as can be seen from Table III, the number of brim curl defects detected is dependent upon the basis weight of the paperboard material as well as the type of humid atmosphere to which the paperboard shells or blanks are subjected. Further, the forming defects are greater when utilizing reoriented paperboard shells and blanks. That is, when forming paperboard containers having the machine direction of the paperboard material extending in a circumferential direction of the paperboard container.

Figure 17:
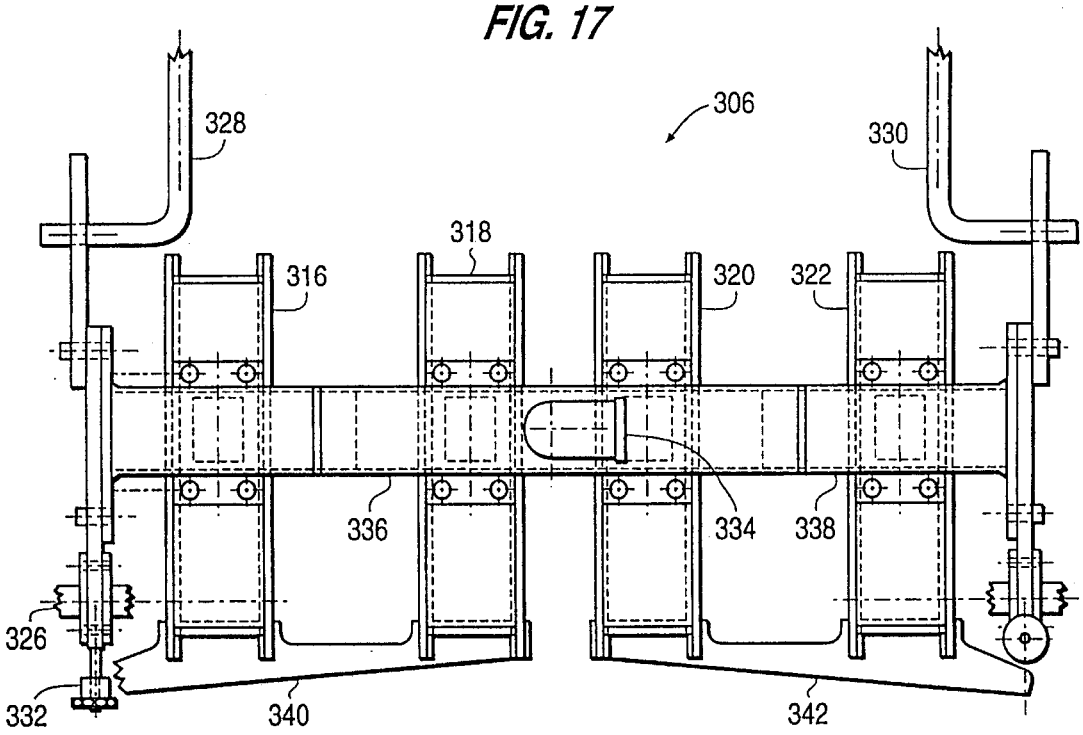
FIG. 17 is a top view of the brim conditioning system of FIG. 16.
Figure 18:
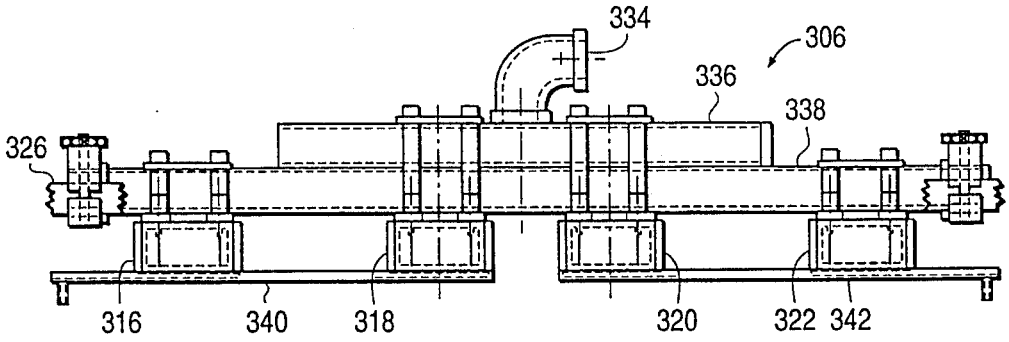
FIG. 18 is an elevational view of the brim conditioning system of FIG. 16.

When forming containers of the type illustrated in FIGS. 6B and 6C, it may be desirable to subject only segments of the portion of the container blank which is to form the brim curl about an upper periphery of the container. That is, in order to form a container which satisfies the above noted strain limits, it is only necessary to precondition those segments of the upper periphery of the blank in the curved areas C. In doing so, an effective brim curl can be formed in the curved regions while eliminating warping of the paperboard material along the elongated edges of the container. In order to accomplish such blank preconditioning, a brim conditioning system illustrated in FIGS. 16–18 is used.

Figure 16:
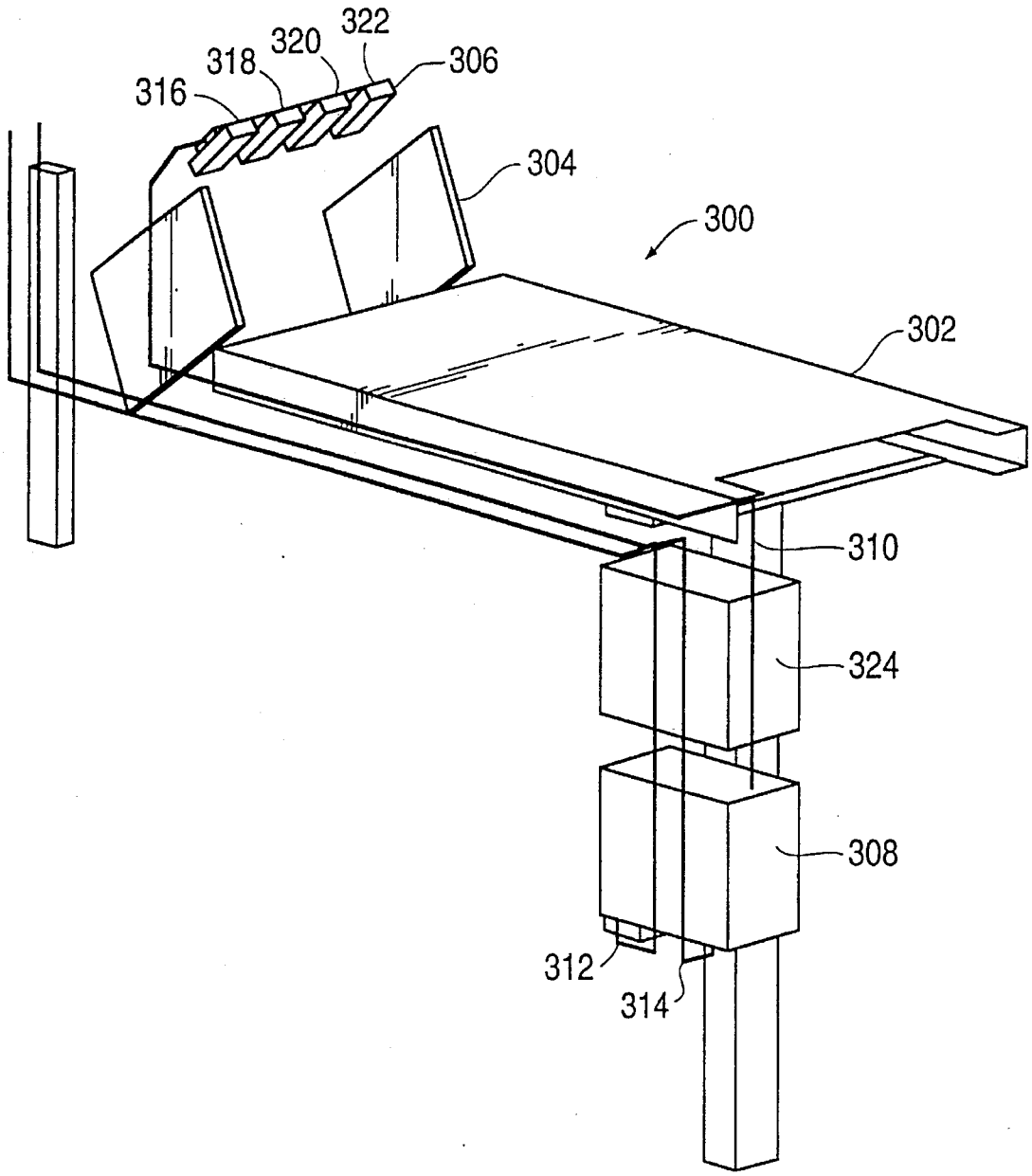
FIG. 16 is a schematic illustration of a container blank hopper incorporating a brim conditioning system in accordance with an alternative embodiment of the present invention.

The preconditioning system 300 is schematically illustrated in FIG. 16 and includes a conveyor 302 for conveying the paperboard blanks in a position similar to that illustrated in FIGS. 8 and 9. The conveyor 302 conveys the blanks in an upright position to the blank magazine 304 which positions the blanks in a manner which allows them to readily be removed by the container forming equipment. This again being similar to that illustrated in FIGS. 8 and 9. Additionally, similar to the embodiment illustrated in FIGS. 8 and 9, the preconditioning system 300 includes a hood (not shown) which accommodates an injection manifold 306, the details of which will be set forth hereinbelow.

As with the previous embodiment, the injection manifold is positioned adjacent to and above the blanks which are positioned in an upright position. The injection manifold 306 receives an air/steam mixture from an air/steam mixing manifold 308 by way of supply line 310. The air and steam are supplied to the air/steam mixing manifold 308 by way of supply lines 312 and 314 respectively. As is illustrated in FIG. 16, the injection manifold 306 is essentially divided into four separate injection manifolds, 316, 318, 320 and 322. While this particular embodiment illustrates four injection manifolds 316–322, the number and position of the injection manifolds will be dictated by the particular container being constructed. In this case, there are four injection manifolds in that the container illustrated in FIG. 6B has four curved sections where pre-conditioning is necessary in order to achieve the previously noted forming strain limits. An electronic control module 324 is also provided for controlling the conveyor 302 as well as the amount of air/steam mixture supplied to the injection manifold 306.

As noted hereinabove, the injection manifold 306 illustrated in FIG. 16 is set forth in detail in FIGS. 17 and 18. The injection manifold 306 is maintained in its position by way of support rods 326, 328 and 330. The injection manifold 306 includes an inlet 334 for receiving the air/steam mixture from the air/steam mixing manifold 308. As discussed hereinabove with respect to the previous embodiments, steam is mixed with air at a ratio in the range of 0.1 CFM steam per 1.0 CFM air to 1.0 CFM steam per 1.0 CFM air. The requisite ratio is dependent upon a number of variables including the initial moisture content of the paperboard material, the parperboard characteristics and thickness as well as the relative humidity of the surrounding environment.

The air/steam mixture supplied to the inlet 334 is subsequently passed under pressure to intermediate manifolds 336 and 338 which are positioned above the individual injection manifolds 316–322. In the embodiment illustrated in FIGS. 17 and 18, the intermediate injection maniflods 336 and 338 are positioned transverse to the direction of movement of the container blanks within the magazine 304 while the preconditioning injection manifolds 316–322 are positioned parallel to the direction of movement of the container blanks. In doing so, the segments of the container blanks to be preconditioned are sufficiently subject to a requisite humid atmosphere in order to achieve the strain limits discussed hereinabove. As with the previous embodiments, it is desirable that the predetermined segments of the container blanks be subjected to a humid atmosphere for a time period in the range of 80 to 150 seconds and preferably 100 to 120 seconds. Accordingly, the individual injection manifolds 316–322 would be dimensioned so as to subject the container blanks to the air/steam mixture for the above noted predetermined time period which is dependent upon the number of containers per minute being manufactured by the container manufacturing device. Additionally, condensation drains 340 and 342 are provided for draining away any condensation which may be created within the intermediate manifolds 336 and 338 or any of the individual injection manifolds 316–322. As with the embodiment illustrated in FIGS. 7–9, with conventional container manufacturing devices, the container blanks are sequentially removed from the hopper and formed into containers in a continuous manner. Accordingly, the dimensioning of the individual injection manifolds 316–322 will be directly dependent upon the speed of the container manufacturing device.

With reference to FIG. 18, each of the individual injection manifolds 316–322 would be designed and manufactured with respect to one another dependent upon the particular dimensions of the container being manufactured. Accordingly, as can be seen from the above noted description, by conditioning only what is to be the corner segments of the periphery of the container formed in accordance with that illustrated in FIG. 6B, allows for the economical use of the steam and also controls warping of the container blank along the elongated portions of the container by limiting the exposure of these segments of the blank to the humid atmosphere.

Test results obtained from using the preconditioning systems illustrated in FIGS. 16–18 are set forth in Table IV hereinbelow. As can be seen from these results, containers having an air/steam ratio of 1.0 forms brims about the upper periphery of the container having no visible defects. Accordingly, by forming containers in accordance with the above noted embodiment, such containers exhibit no defects while permitting the economical use of the steam and controlling blank warp.

TABLE IV

BLANK STEAMER MANIFOLD TRIAL RESULTS
LARGE BRIM CONTAINERS

| | | | BRIM MOISTURE CONTENT, % | |
|---|---|---|---|---|
| CONDITION | STEAM C.F.M. | AIR C.F.M. | FILLER AMBIENT | TAPPI 73F, 50% R.M. |
| CONTROL | 0.0 | 0.0 | 4.5 | 5.8 |
| LOW | 0.5 | 1.5 | 5.6 | 6.5 |
| MEDIUM | 1 | 1 | 7.0 | 8.2 |

TABLE IV-continued

BLANK STEAMER MANIFOLD TRIAL RESULTS
LARGE BRIM CONTAINERS

| | | | BRIM CRACKING DEFECTS[1] | |
|---|---|---|---|---|
| CONDITION | STEAM C.F.M. | AIR C.F.M. | FILLER AMBIENT | TAPPI 73F, 50% R.H. |
| CONTROL | 0.0 | 0.0 | 2.8 | 0.3 |
| LOW | 0.5 | 1.5 | 2.2 | 0.2 |
| MEDIUM | 1.0 | 1.0 | 0.0 | 0.0 |

[1]DEFECT KEY
0 = None
1 = Slight - Dimples, no cracks
2 = Moderate - Visible cracks on outside of brim
3 = Severe - Large cracks which propagate to inside of cup While the present invention has been described with reference to a preferred and alternative embodiment, it will be appreciated by those skilled in the art that the invention may be practiced otherwise than as specifically described herein without departing from the spirit and scope of the invention. It is, therefore, to be understood that the spirit and scope of the invention be limited only by the appended claims.

What is claimed is:

1. A paperboard container formed of a paperboard material having a basis weight B in pounds per 3,000 square feet of material, the container having a defect free curved and curled brim formed about an upper periphery thereof wherein a maximum forming strain in percent of an inside brim circumference exceeds $4.41+0.0156\times B$, and B is in a range of 130 to 200 pounds per 3,000 square feet of material.

2. The container as defined in claim 1, wherein said container is a cup having a circular cross-section.

3. The container as defined in claim 2, wherein a machine direction of said paperboard material is oriented substantially transverse to a circumferential direction of said cup.

4. The container as defined in claim 1, wherein said container has a non-circular cross-section having rounded corners.

5. The container as defined in claim 4, wherein said container has a substantially rectangular cross-section.

6. The container as defined in claim 4, wherein said container has a substantially square cross-section.

7. The container as defined in claim 1, wherein said container has an oval cross-section having rounded ends and one of straight and curved sides extending between said rounded ends.

8. The container as defined in claim 1, wherein side walls of the container are tapered inwardly from a top of the container to a bottom of the container.

9. The container as defined in claim 1, wherein side walls of the container are substantially vertical.

10. A paperboard container formed of a paperboard material having a basis weight B in pounds per 3,000 square feet of material, the container having a defect free curved and curled brim formed about an upper periphery thereof wherein a machine direction of said paperboard material is oriented substantially in a circumferential direction of the container and a maximum forming strain in percent of an inside brim circumference exceeds 4.0 percent, and B is in a range of 130 to 220 pounds per 3,000 square feet of material.

11. The container as defined in claim 10, wherein said container is a cup having a circular cross-section.

12. The container as defined in claim 10, wherein said container has a non-circular cross-section having rounded corners.

13. The container as defined in claim 12, wherein said container has a substantially rectangular cross-section.

14. The container as defined in claim 12, wherein said container has a substantially square cross-section.

15. The container as defined in claim 10, wherein said container has an oval cross-section having rounded ends and one of straight and curved sides extending between said rounded ends.

16. The container as defined in claim 10, wherein side walls of the container are tapered inwardly from a top of the container to a bottom of the container.

17. The container as defined in claim 10, wherein side walls of the container are substantially vertical.

* * * * *